US010065287B2

(12) United States Patent
Straßer et al.

(10) Patent No.: US 10,065,287 B2
(45) Date of Patent: Sep. 4, 2018

(54) SPINDLE OF A TOOL GRINDING MACHINE

(71) Applicant: ISOG TECHNOLOGY GMBH, Weilheim (DE)

(72) Inventors: Günther Straßer, Wildsteig (DE); Adolf Feuchthuber, Weilheim (DE); Reinhard Endres, Weilheim (DE)

(73) Assignee: ISOG TECHNOLOGY GMBH, Weilheim (DE)

( * ) Notice: Subject to any disclaimer, the term of this patent is extended or adjusted under 35 U.S.C. 154(b) by 113 days.

(21) Appl. No.: 15/134,709

(22) Filed: Apr. 21, 2016

(65) Prior Publication Data

US 2016/0229027 A1 Aug. 11, 2016

Related U.S. Application Data

(63) Continuation of application No. PCT/EP2014/072304, filed on Oct. 17, 2014.

(51) Int. Cl.
*B24B 41/06* (2012.01)
*B24B 41/04* (2006.01)
*B24B 3/00* (2006.01)

(52) U.S. Cl.
CPC ..... *B24B 41/066* (2013.01); *B24B 3/00* (2013.01); *B24B 41/042* (2013.01)

(58) Field of Classification Search
CPC . B23Q 1/26; B23Q 1/28; B23Q 1/285; B23Q 1/32; B23Q 1/38; B23Q 1/385; B23Q 1/56; B23Q 1/70; B23Q 3/12; B23Q 3/18; B24B 3/247; B24B 5/02; B24B 41/066
See application file for complete search history.

(56) References Cited

U.S. PATENT DOCUMENTS 4,919,547 A * 4/1990 Schwartzman ..... F16C 17/10 384/100
5,833,522 A * 11/1998 Niino ..... B23Q 1/38 451/294
6,375,542 B1 4/2002 Kashchenevsky
8,376,670 B2 * 2/2013 Shinano ..... B23B 31/265 409/136
8,950,987 B2 * 2/2015 Okada ..... B23B 35/00 409/132
9,644,686 B2 * 5/2017 Geisselmann ..... F16D 1/108
(Continued)

FOREIGN PATENT DOCUMENTS

DE 33 22 007 12/1984
DE 240 157 10/1986
(Continued)

OTHER PUBLICATIONS

The International Search Report dated Mar. 20, 2015 for International Application No. PCT/EP2014/072304.

*Primary Examiner* — Timothy V Eley
(74) *Attorney, Agent, or Firm* — Yakov S. Sidorin; Quarles & Brady LLP

(57) ABSTRACT

The positioning of a cylindrical workpiece (that has to be machined by grinding) can be performed particularly precisely if the workpiece abuts to at least one, preferably two, static supporting elements and is fixed in a collet of a spindle, which allows a wobble compensation as well as a radial displacement of the spindle axis relative to the longitudinal axis of the workpiece.

30 Claims, 8 Drawing Sheets

(56) References Cited

U.S. PATENT DOCUMENTS

| | | | | |
|---|---|---|---|---|
| 2005/0220556 | A1* | 10/2005 | Takase | B23B 31/263 409/233 |
| 2012/0121356 | A1* | 5/2012 | Tatsuda | B23Q 1/0018 409/201 |
| 2013/0129414 | A1* | 5/2013 | Geisselmann | B23B 31/113 403/322.4 |
| 2015/0151395 | A1* | 6/2015 | Halm | B23Q 5/10 173/197 |

FOREIGN PATENT DOCUMENTS

| | | |
|---|---|---|
| DE | 89 15 435 | 6/1990 |
| DE | 101 18 664 | 11/2002 |
| DE | 10 2009 031 027 | 1/2011 |
| JP | S61-121860 A | 6/1986 |
| JP | H01-281 861 | 11/1989 |
| JP | H2-39803 U | 2/1990 |
| JP | H11-244088 | 9/1999 |
| KR | 10-2010-0049063 | 5/2010 |
| WO | 2004/052592 | 6/2004 |

* cited by examiner

SPINDLE OF A TOOL GRINDING MACHINE

CROSS-REFERENCE TO RELATED APPLICATIONS

This application is a continuation of pending International Application No. PCT/EP2014/072304 filed on 17 Oct. 2014, which designates the United States and claims priority from German Application No. 10 2013 111 599.3 filed on Oct. 21, 2013. The disclosure of each of these patent documents is incorporated herein by reference.

BACKGROUND

1. Field of the Invention

The invention relates to a tool grinding machine, and, in particular, to a spindle for a collet of a tool grinding machine.

2. Description of Relevant Art

Tool grinding machines usually have a collet for clamping an at least substantially cylindrical workpiece of the later tool. Typical examples of such tools manufactured by grinding are drills and milling cutters.

To machine the workpiece from all sides, it is rotated around the cylinder axis during machining. Ideally, the rotational axis and the longitudinal axis of the workpiece are identical in the mathematical sense. In practice, however, there are tolerances for many reasons. For example, the repeatability in clamping the workpiece is limited. Also bearing tolerances of the spindle and machining forces acting on the workpiece reduce the precision of the finished tools. However, the precision requirements for drills or milling cutters are in a range of few microns. Therefore, the workpiece is generally supported on one or more steady rests, in order to prevent a deflection of the workpiece during machining.

In EP 1419852 A1, a tool grinding machine with a spindle for a collet is described. The collet is located at the head end of the spindle, which is rotatably supported by two hydrostatic bearings opposite a bearing block. The workpiece is received by the collet and is additionally supported via a steady rest as a static bearing. The hydrostatic bearings replace the usual ball bearings. The hydrostatic bearing facing towards the workpiece allows a larger radial clearance than the hydrostatic bearing facing away from the workpiece; thereby an over-determined bearing should be avoided and inaccuracies in concentricity should be compensated. A lateral deflection of the spindle should be avoided by a correspondingly high pressure in the hydrostatic bearings.

In DE 10 2005 007 038 A1, a workpiece spindle stock for a tool grinding machine is described. The workpiece spindle stock has as usual a spindle with a collet to receive the workpiece. In order compensate inaccuracies in clamping, the so-called eccentricity of the workpiece is measured and corrected after each clamping action. For the correction, the spindle has a releasable alignment interface, which allows a motorized alignment of the collet and thus of the workpiece orthogonally to the spindle axis.

In DD 2 40 157 A1, a spindle of a machine tool is described. The spindle has a drive shaft and a working spindle. The drive shaft and the work spindle are coupled via a flexible membrane disc as rotational coupling. Machining forces occurring in axial direction are absorbed by angular contact ball bearings. The workpiece-side angular contact ball bearing is configured as a fixed bearing and the drive shaft side angular contact ball bearing allows wobble compensation.

In DE 10 2009 031 027 A1, a split tool spindle for a combined milling and turning machine with a stationary and a rotating tool is described. The tool spindle has a clamping head with a spindle shaft which is connected via a coupling to the shaft of a drive motor. For milling, the tool spindle is fixed hydrostatically in the collet.

SUMMARY

The object of the invention is to provide a machine tool that allows an increased machining precision and easier handling compared to the prior art.

The invention is based on the knowledge that a precise guidance of the work-piece would be best achieved by one or preferably two steady rests. However, the repetition accuracy in clamping the workpiece in the collet is inferior to the guidance of the workpiece by steady rests, so that there is a risk that the spindle and/or workpieces deform elastically when being rotated around their axes, which is detrimental to precision. The hydrostatic spindle bearing as proposed in the prior art is not convincing, because either the bearings are set to be soft in order to compensate for the wobble movement, or are stiff in order to receive the radial machining forces. This target conflict in the adjustment of the bearing pressure cannot be solved.

The core of the invention is a spindle with a bearing which allows a wobble compensation and/or compensation of a radial offset between a rear spindle portion, i.e. the drive shaft and the longitudinal axis of a workpiece fixed in a collet of the spindle.

As usual, the spindle has a front portion which is called the spindle head and which can as usual receive a collet for a workpiece, i.e. it has for example a recess for a collet receptacle. The corresponding collet receptacle can for example be inserted in an axial recess of the spindle head. Alternatively, the collet receptacle can be an integral part of the spindle head. The longitudinal axis of the spindle head corresponds at least substantially to the longitudinal axis of the collet and is also referred to as a first longitudinal axis. Furthermore, the spindle has a rear spindle portion, which is arranged in the extension of the first longitudinal axis. The rear spindle portion is the drive shaft of the spindle head and has a second longitudinal axis. The rear spindle portion can be received, as usual, by a bearing block or by a spindle stock of a machine tool, and is designed accordingly. For example, the rear spindle portion can be at least one seat for at least one bearing for the rotatable supporting of the rear spindle portion at a bearing support. Alternatively (or additionally) at least one bearing surface of a rotatable bearing can be formed at the rear spindle portion. Further spindle portions can follow the rear spindle portion. At least one bearing is between the spindle head and the rear spindle portion (i.e. the drive shaft) that allows a tilt of the first axis relative to the second axis, and/or (preferably and) allows a radial displacement of the first axis relative to the second axis. As used herein, the terms tilt or tilting means pivoting the both axes relative to each other. This pivoting is preferably enabled in two directions said two directions being linearly independent from each other, thereby enabling to rotate the spindle around the second axis while the first axis is stationary and not aligned with the second axis. This means that the spindle head is enabled to wobble, relative to the rear spindle portion. This ability to wobble enables to compensate errors in alignment of the workpiece with the second axis.

Preferably, the bearing transmits pressure and/or tensile forces in axial direction of the first and the second axis, respectively, between the spindle head and the rear spindle portion. For the transmission of torque from the drive shaft to the spindle head, the bearing is either torsion-proof or is bridged by a torsion-proof coupling.

In practice, the first and second axes lie extremely close to one another and are only minimally tilted against each other. The typical radial offset is in the range of a few hundredths of a millimeter (corresponds to less than 100 to 10 μm). The tilt typically is in the range of a few hundredths of a degree. The bearing should preferably allow a radial offset by a few millimeters and a tilt by a few degrees, inter alia because the free movement of the bearing can then be checked manually.

It is not described further, whether the coupling is part of the bearing or not, because it does not create a functional difference whether a corresponding coupling is integrated into the bearing or whether the coupling is regarded as an additional component. In the context of this application, the entirety of components that allows a limited movement of the spindle head relative to the rear spindle portion, is understood as bearing. The entirety of components that allows transmission of torque between the spindle head and the rear spindle portion, is understood as a coupling. Also by this definition it is clear that the (rotary) coupling strictly speaking is always part of the bearing, because it preferably completely inhibits the rotational movement between the spindle head and the rear spindle portion, and thereby limits the movement.

A machine tool with the spindle as described above allows to support and/or fix the workpiece at two points by fixable supporting elements, as for example steady rests, for example by one or more clamping fingers (wherein the rotation around the longitudinal axis should remain possible). The position and location of the rod-shaped workpiece is thus determined exclusively by the static support elements, which support and receive the machining forces at least in the radial direction. In particular machining forces acting radially on the rod-shaped work-piece can thereby be reliably absorbed without a significant change in orientation or position of the workpiece takes place. Any inaccuracies occurring in the collet in clamping the workpiece are compensated by the bearing between the spindle head and the rear spindle portion, thereby increasing the precision. Machining forces acting axially on the workpiece as well as torques may be transmitted via the bearing from the spindle head to the rear spindle portion and may for example be inserted via a spindle stock into the structure of the machine tool. A once found setting of the support elements must not be changed when a new workpiece of a series of identical workpieces is to be processed. Only for a new series, that is when workpieces of different dimensions are to be processed, a one-time adjustment of the support elements is necessary for the new series. The bearing between the spindle head and the drive shaft thus enables three advantages over rigid spindles: Not only the accuracy of the positioning of the workpiece increases, but also set-up times are shortened. In addition, the supporting of the drive shaft at the machine tool can be done comparatively simple, because an expensive precision bearing is no longer necessary. If the precision of the drive shaft positioning relative to the bearing block is reduced, however, the steady rests have to be adjusted accordingly for the first calibration or adjustment of the position of a workpiece or a calibration mandrel, respectively. Often, it is thus easier not to reduce the precision of the drive shaft positioning relative to the bearing block. This allows to position the workpiece or calibration mandrel first (i.e. to "calibrate") and then to position the steady rests at the workpiece or the calibration mandrel, respectively.

Preferably, the spindle has a centering device for centering the spindle head and the rear spindle portion to one another. The term "center" means that the spindle head and the rear spindle portion are aligned with each other, such that the first axis and the second axis are preferably at least approximately aligned or are at least in a defined orientation to one another. Preferably, the centering device allows to lock the spindle head with relation to the rear spindle portion, and to remove the locking.

For this purpose, the spindle head and the shaft may for example have respectively opposite centering surfaces, between which surfaces at least one centering slider is moveable between at least a first position and a second position. In the first position, the centering surfaces are clamped against each other by the slider, wherein the bearing is bridged in a locking manner by the centering slider, and wherein the spindle head and the rear portion are mutually centered. In the second position, the locking is released. The centering slider may for example have a tapered portion and a thickened portion, wherein for the purpose of centering, the thickened portion is pushed in a gap between the centering surfaces, in order to clamp the centering surfaces against each other. The centering slider may for example be a ring or ring segment being axially displaceable between an axial centering pin of the spindle head and a centering bushing of the rear spindle portion. Of course, the centering bushing may also be arranged on the spindle head and the centering pin on the rear spindle portion.

The centering device allows to precisely insert the workpiece in the spindle head when changing the workpiece, and in particular allows to use an automatic loading device therefore, e.g. a robot-gripper as known for example from DE 10 2011 052 976, without having to provide a position detection for the spindle head. Once the machining of a workpiece is finished, the spindle head is centered with respect to the rear spindle portion by means of the centering device. The position and orientation of the workpiece are now known very precisely, and it may be removed e.g. by a robot-gripper from the collet, without sensors being necessary for detecting the position of the workpiece. In addition, a new work-piece may be inserted very precisely in the collet. Subsequently, the centering device is opened and the centering is accordingly released, i.e. the bearing is now released and allows for wobble compensation and/or radial displacement. Preferably, the workpiece is just now preloaded against least one of the support elements. In doing so, the bearing compensates differences in position or orientation, respectively, of the workpiece's longitudinal axis (which axis is rigidly connected to the spindle head via the collet) and the rear spindle portion. Thereby, the workpiece is precisely rotated around its own, and not around a second axis, when rotating the rear spindle portion. Preferably, the bearing has a first and/or a second air bearing. For example, the first air bearing may have surfaces confirming to surface(s) of spherical surface segment(s), and the second air bearing may have planar bearing surfaces, whose surface normals are parallel to the first or second axes. An embodiment of the bearings as air bearings or as combination of two air bearings allows a compensation of wobble movements and a radial displacement of the first to the second axis, without any friction having to be overcome. Precision is thus further increased. In addition, the air bearing embodiment allows a compact design and a very high stiffness in axial direction. The gap between the bearing surfaces of the air bearings usually is only a few micrometers (μm), and is therewith in the range of the desired machining accuracy of the workpiece. Correspondingly, is air bearing is extremely stiff in axial direction of the spindle, thereby further increasing the possible precision of the workpiece's positioning and thus its machining. Simply said, air bearings are plain bearings, in which the two sliding surfaces are separated from one another by air cushions. Thus, the air acts as a lubricant. Instead of air as bearing lubricant, other fluids may be used as well. Thus, the term air bearing pars pro toto stands for hydrostatic bearing. For example, the coolant used during grinding may be used as lubricant for the bearing. Thereby, the lubricant's removal or separation being necessary for other (non-gaseous) fluids can be omitted.

For example, the bearing may have a ring-shaped or at least a ring-segment-shaped intermediate part. The intermediate part preferably has at least one first spherical-segment-shaped bearing surface, and has at least a second plane bearing surface on its side facing away from the spherical-segment-shaped bearing surface. In this sense, the intermediate part may also be called an intermediate block. Due to the planar bearing surfaces, a radial displacement of the first to the second axis is possible. Due to the bearing surfaces being shaped to conform to a surface of a spherical segment, a tilt of the first axis to the second axis is possible. Therefore, the sphere center of the spherical segment is preferably on the first or the second axis. More preferably, the sphere center, that is the point around which the spindle head is pivotable against the rear portion, lies on the corresponding axis in front of the collet. Thereby, the angle between the longitudinal axis of the work-piece and the longitudinal axis of the rear spindle portion, which has to be compensated by the wobble, becomes smaller. Particularly preferred, the sphere center lies above the center of gravity of the spindle head (preferably with a clamped workpiece). In the case of a vertical spindle axis, the opening of the collet is thus always directed upwards.

Alternatively, the two bearing surfaces of the intermediate block may be shaped to conform to a surface of a segment of a cylinder. Correspondingly, the respective complementary bearing surfaces of the spindle head and the rear spindle portion are shaped as a surface of a segment of a cylinder. In other words, the bearing has a first and/or second partial bearing being preferably embodied as air bearing (more generally, hydrostatic bearing), wherein the first partial bearing has two mutually complementary first bearing blocks with first cylinder-segment-shaped bearing surfaces, and the second partial bearing has two mutually complementary bearing blocks with second cylinder-segment-shaped bearing surfaces. Each of the two partial bearings allows a tilting movement of respective bearing blocks in the plane orthogonally intersecting the center axis of the longitudinal axis of the respective cylinder surface segments, and a translation in the plane being orthogonal thereto. Coincidentally, rotational movements around the section axis of the two planes, and thus torques may be transmitted between the bearing blocks. For the sake of completeness it is noted that the cylinder longitudinal axes of the cylinder surface segments should not be parallel to each other, but preferably should form a preferably right angle at least in an axial projection along the first and/or the second axis. Preferably, both cylinder longitudinal axes lie in one plane; thus it becomes possible to pivot the spindle head about one point in two linearly independent directions, like in a ball joint. The cylindrical longitudinal axes may be matched by corresponding adjustment of the radii of the cylinder segment surfaces and/or the alignment of the cylinder segment surfaces to each other.

If wobble compensation can be omitted, non-rotation-symmetrical bearing surfaces may be used instead of cylinder-surface-shaped bearing surfaces, for example prismatic bearing surfaces. In the simplest case, the bearing surfaces are V-shaped.

Typically, the bearing surfaces are surfaces of correspondingly complementary bearing blocks between which there is an air gap (more generally fluid gap) being limited by the bearing surfaces. Preferably, the opposite, i.e. complementary bearing surfaces or the corresponding bearing blocks of at least one air bearing are preferably magnetically preloaded against each other. The term "preload" means the application of a force compressing the bearing surfaces, which defines the gap thickness at a given air flow rate through the bearing. This allows for a particularly compact and rigid air bearing. The preloading force preferably exceeds the machining forces acting in axial direction, such that they do not cause any significant bearing clearance. Preferably, the preloading force FV is at least 1.2-times the machining forces to be absorbed in axial direction $F_{Bax}$ ($F_y \geq 1.2 \cdot F_{Bax}$, particularly preferred $F_y \geq 2 \cdot F_{Bax}$, more preferably $F_y \geq 10 \cdot F_{Bax}$). These high preloading forces can easily be achieved by permanent magnets embedded in the bearing blocks.

Magnetic preloading may preferably be carried out by permanent magnets which are embedded in mutually complementary bearing blocks. In the simplest case, magnets are arranged on both sides of the gap such that the magnetic flux bridges the gap, i.e. flows from the north pole of a first magnet in a first bearing block, passing the gap, to a south pole of at least one second magnet in the opposite second bearing block. However, also a single magnet may be sufficient, if its two poles are connected via at least one magnetic conductor, wherein the magnetic flux passes through the gap. In all cases, the magnetic flux between the north and south pole of at least one magnet or at least two different magnets is guided such that it bridges the air gap between the bearing surfaces.

For this purpose, the north and south pole of the magnets in the complementary bearing blocks can be aligned such that the magnets attract each other and thus exert a force on the bearing blocks that compresses the bearing surfaces. Of course, also back iron plates or the like may be used to guide the magnetic fields. Only for the sake of simplicity, only north and south poles are referred in the context of this application, because the field lines entering or leaving said north and south poles may be "displaced" to nearly any location by magnetic conductors with better magnetic conductivity compared to the material surrounding same (as commonly used for back iron plates). It is only important that the magnetic flux usually illustrated by magnetic field lines from a magnetic north pole of a magnet being supported on a first bearing block, enters from the bearing surfaces into the air gap in a manner preferably orthogonal to the corresponding bearing surface, and on the opposite side enters in a south pole of a magnet being supported on the opposite bearing block.

Alternatively, the magnetic flux may be guided from the north pole of a magnet through the air gap, and with a magnetic conductor through the opposing bearing block, such that it again passes through the air gap and passes to the south pole of another or of the same magnet. The north and south pole can thus be arranged in almost any orientation and position, as long as the magnetic flux is guided e.g. via a magnetic conductor, passing through the air gap.

In a particularly simple embodiment, each of the bearing blocks has at least one recess, in each of which at least one permanent magnet is arranged. For example, the permanent magnet may be arranged in a recess of the corresponding bearing surface. After the (at least one) permanent magnet has been inserted in the recess, the recess may be sealed for example with a polymer, preferably such that the bearing surface is continued by the sealing. This means that that the gap between the bearing surfaces is as uniform as possible. Since the bearing surfaces of hydrostatic bearings are typically grinded-in, this is accordingly readily possible if firstly the magnets are inserted, the recess is closed with the polymer, and the bearing surfaces are grinded-in or polished after curing; it is particularly preferred to expose the north or the south pole or a magnetic conductor connected to such north or south poles, and thereby part of the bearing surface. Thereby, a particularly high preloading can be achieved. Alternatively, the (at least one) magnet may be inserted from the rear side facing away from the bearing surface, or from a narrow side connecting the bearing surface with the rear side, into a, for example, blind hole-like recess, wherein the distance of the magnet to the bearing surface should be as small as possible. The north and/or the south pole of the magnet should preferably point towards of the opposite bearing surface.

Of course, also an entire bearing block or segment of a bearing block can be made of a permanent magnetic material.

A torque transmission between the rear spindle portion and the spindle head can be done by a coupling bridging the bearing.

For example, the coupling may have a coupling element being freely displaceable and preferably tiltable with respect to the first and/or second axis. The coupling element preferably surrounds the bearing, or part of it in a ring-shaped manner. The rear spindle portion is connected to the coupling element via at least one, but preferably two at least approximately parallel (with a tolerance within ±15°) first struts. The first struts are arranged preferably on opposing sides of the first and/or the second longitudinal axis laterally to the drive shaft and the coupling element, and run preferably at least approximately (with a tolerance within ±15') in a plane orthogonally intersecting the first and/or second axis. In a top view on the plane, the ends fastened to the coupling element point in preferably at least approximately (±15°) diametrically opposite directions. Thus, when transmitting a torque from the drive shaft to the coupling element via the struts, independent of the torque direction, always one of the both strut is tensile-loaded, whereby the coupling is very stiff. The coupling element is connected to the spindle head in a similar manner, that is via at least one, preferably two second struts being at least approximately (with a tolerance within ±15°) parallel to each other. Also the second struts are preferably arranged on two opposing sides of the first and/or the second axes, and are at least approximately (±15°) parallel to each other. Preferably, the longitudinal axes of the second struts are in the same plane as those of the first struts, or in a plane being at least approximately (±15°) parallel thereto, but they are tilted against the first struts, i.e. the longitudinal axes of the struts form a parallelogram at least in the projection on one of the both planes. The ends fastened to the coupling element point in preferably at least approximately (±15°) diametrally opposite directions.

Via the struts, torques can be transmitted reliably from the rear spindle portion serving as drive shaft for the spindle head, to the spindle head. A radial displacement of the spindle head with respect to the rear spindle portion being usually received in the bearing block of the machine tool, i.e. the first against the second axis is not hindered by the coupling even when rotating the spindle; the struts are only slightly elastically deformed. These radial compensation movements are comparatively small, typically in an order of some hundredths millimeter (approximately 10 to 100 μm). Given a strut length of for example 10 cm, the restoring forces impacting on the bearing are thus negligible. In case of a tilting movement, the struts are slightly twisted and also bent along the longitudinal axis. However, the thereby generated restoring force is very small due to the only slight tilting of the first axis to the second axis in tool spindles of typically only a few hundredth degrees, and does not measurably impact concentricity of a workpiece guided in a steady rest. The coupling offers the advantage of high torsion stiffness, simultaneously compensating a radial displacement as well as mutual wobble movement of the first and second axes, at low costs and reduced spatial requirements. The latter holds true especially when the struts are manufactured of a band-like elastic material, e.g. of spring steel strips. Such band-like struts may for example be arranged in a transverse plane around the intermediate block, i.e. the longitudinal axes of the struts lie in the plane. The transverse plane is preferably intersected orthogonally by the longitudinal axis of the intermediate block. The longitudinal axis of the intermediate block is preferably coincident with the first and/or the second axis.

Preferably, the spindle head has a continuous recess, in one side of which a collet is located. The collet may be connected with a tension element being slideable in the recess and preloaded against the spindle head, for example a rod. This allows the collet to be opened and/or closed by sliding the rod. Preferably, the rod is preloaded in one direction, e. g. tensioned. To open the collet, it is sufficient to move the rod against the preload towards the collet by means of a piston being arranged e.g. in the rear spindle portion or being arranged in a subsequent spindle portion.

The machine tool has the spindle as described above with a collet for clamping-in the workpiece as precise as possible, such as a collet for the workpiece. In this sense, the term collet is used as a synonym for any clamping means. The rear spindle portion is supported in at least one bearing block. In addition, the machine tool preferably has at least one, preferably two steady rests, of which at least one is formed as a guide prism. Such guide prisms are prismatic blocks having a generally V-shaped groove at which a workpiece may be attached. A clamping finger can press the workpiece against the guide prism. In addition, the tool has, as usual, a grinding and/or milling head, a machine controller, often also a cabin and/or a charging and discharging device.

BRIEF DESCRIPTION OF THE DRAWINGS

In the following, the invention will be described by way of example, without limitation of the general inventive concept, on examples of embodiment and with reference to the drawings.

Figure 1:
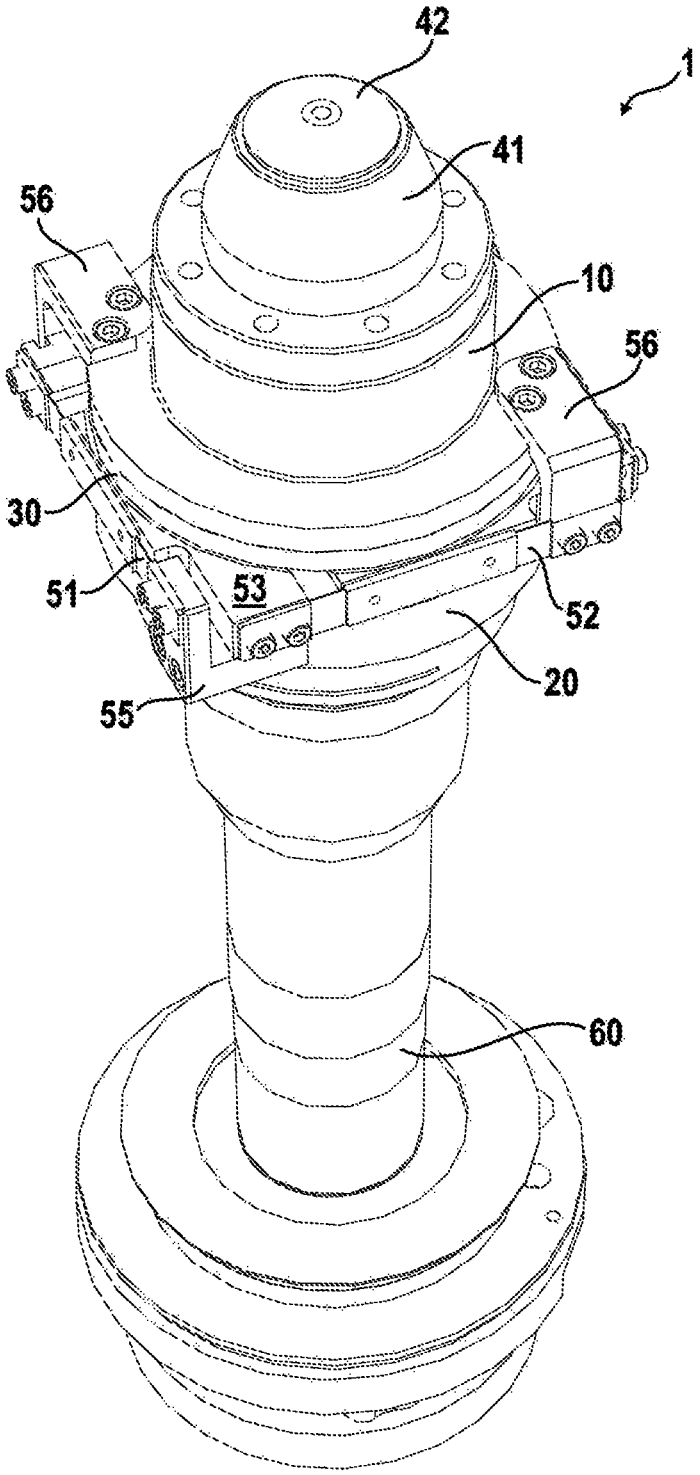
FIG. 1 shows an isometric view of a spindle.
Figure 2:
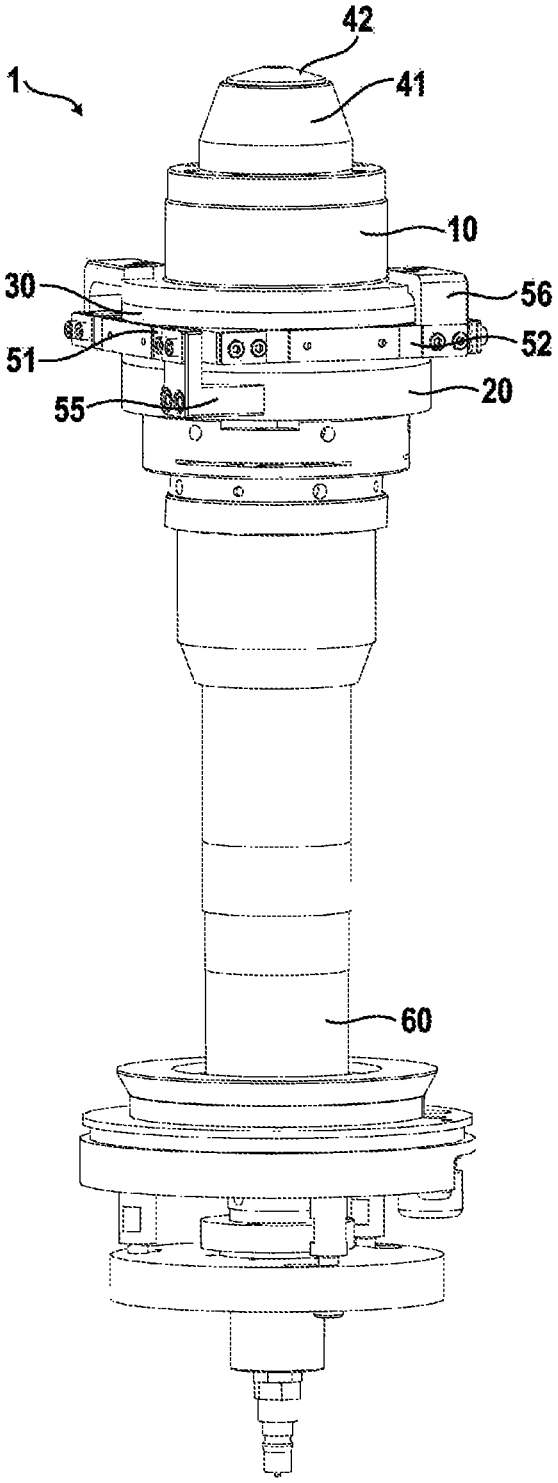
FIG. 2 shows a first side view of a spindle.
Figure 3:
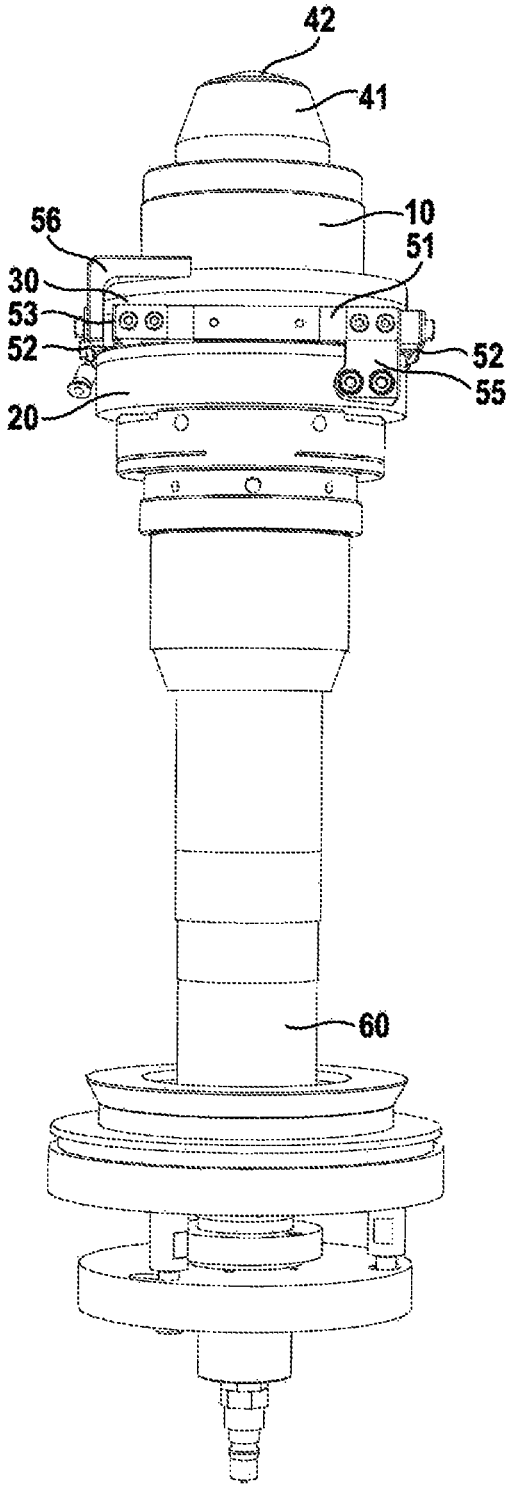
FIG. 3 shows a second side view of the spindle.
Figure 4:
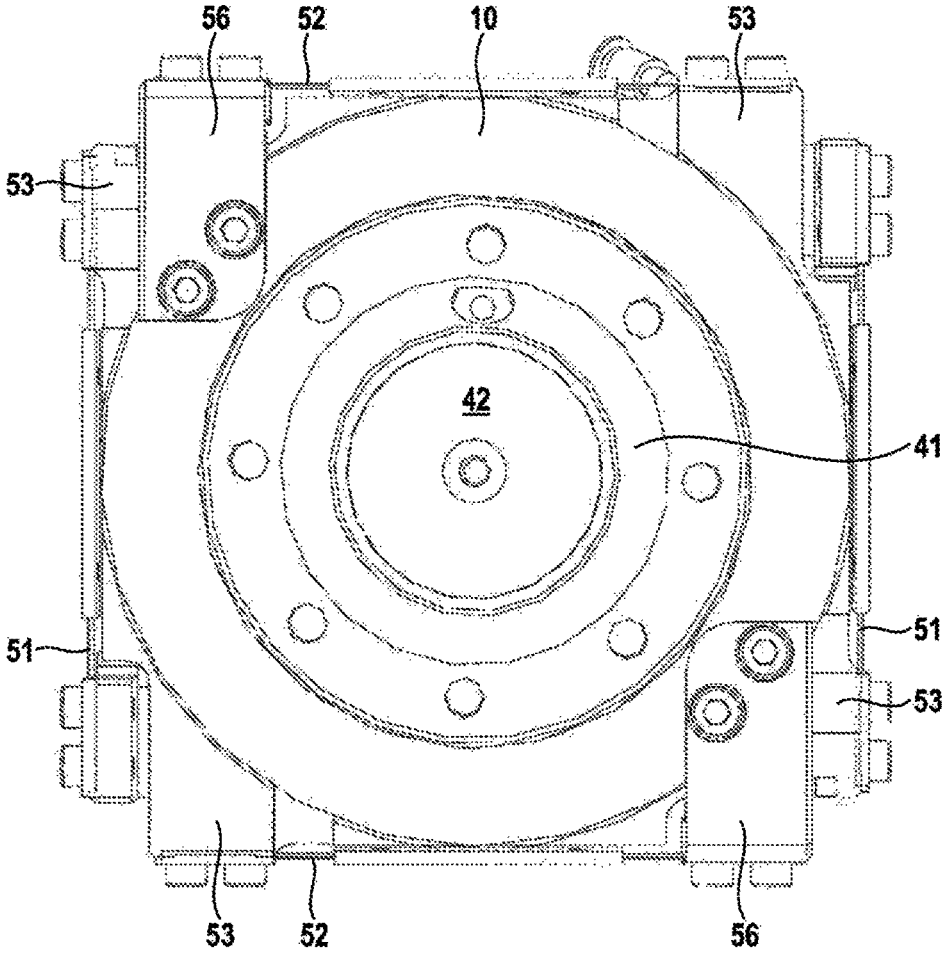
FIG. 4 shows a top view of the spindle.
Figure 5:
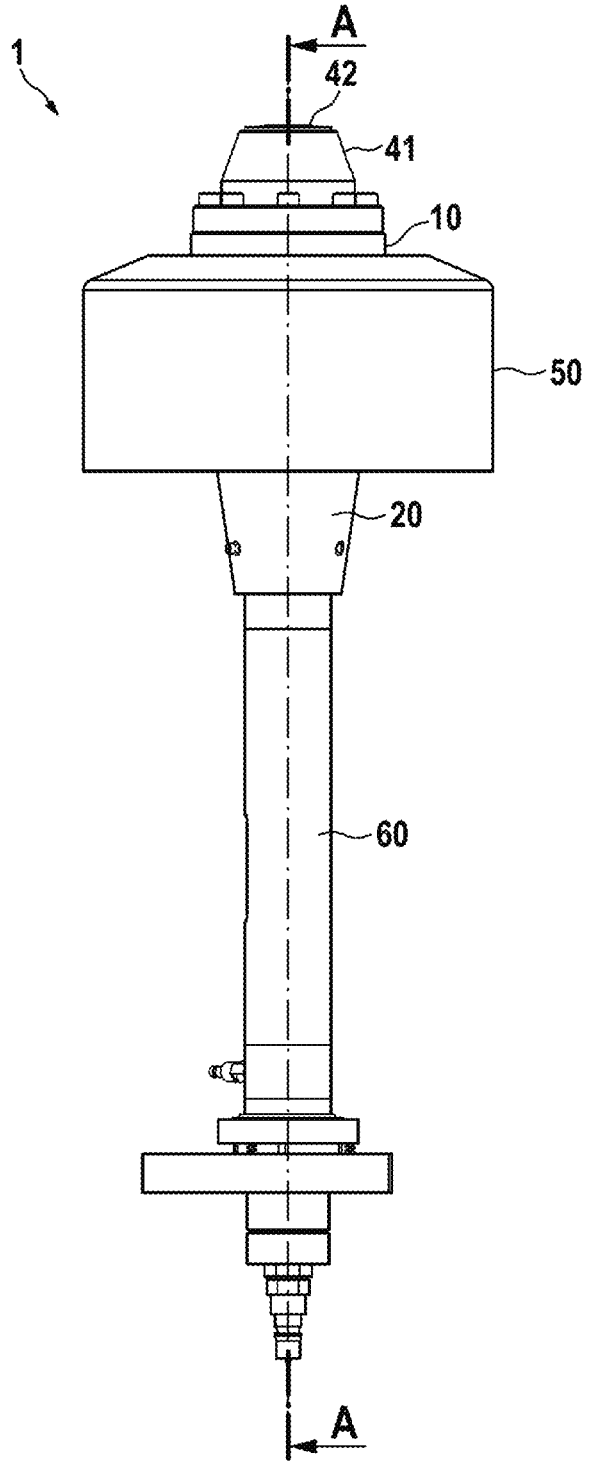
FIG. 5 shows a side view of the spindle with mounted cover.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

The spindle 1 in FIG. 1 has a spindle head 10 with a collet receptacle 41 being located in a collet 42. The spindle head 1 has a bearing block 11 whose rear part may be protected by a cover 50 (see FIG. 6 and FIG. 7). In the illustrated embodiment, the collet receptacle 42 is a component being connected to the bearing block 11; alternatively, the bearing block 11 may also have a recess formed as a collet receptacle.

To the rear, i.e. on the side facing away from the collet 42, the spindle 1 has a drive shaft 20, which is also referred to as a rear spindle portion 20. An air supply and actuating device 60 is attached to the drive shaft 20. The spindle 1 can be connected to a machine tool via the drive shaft 20, i.e. the drive shaft can be connected to a drive and can be received by a bearing block of the machine tool (not shown). The bearing block thereby allows, as usual, only a rotation of the drive shaft about its longitudinal axis, i.e. about the second axis.

Figure 6:
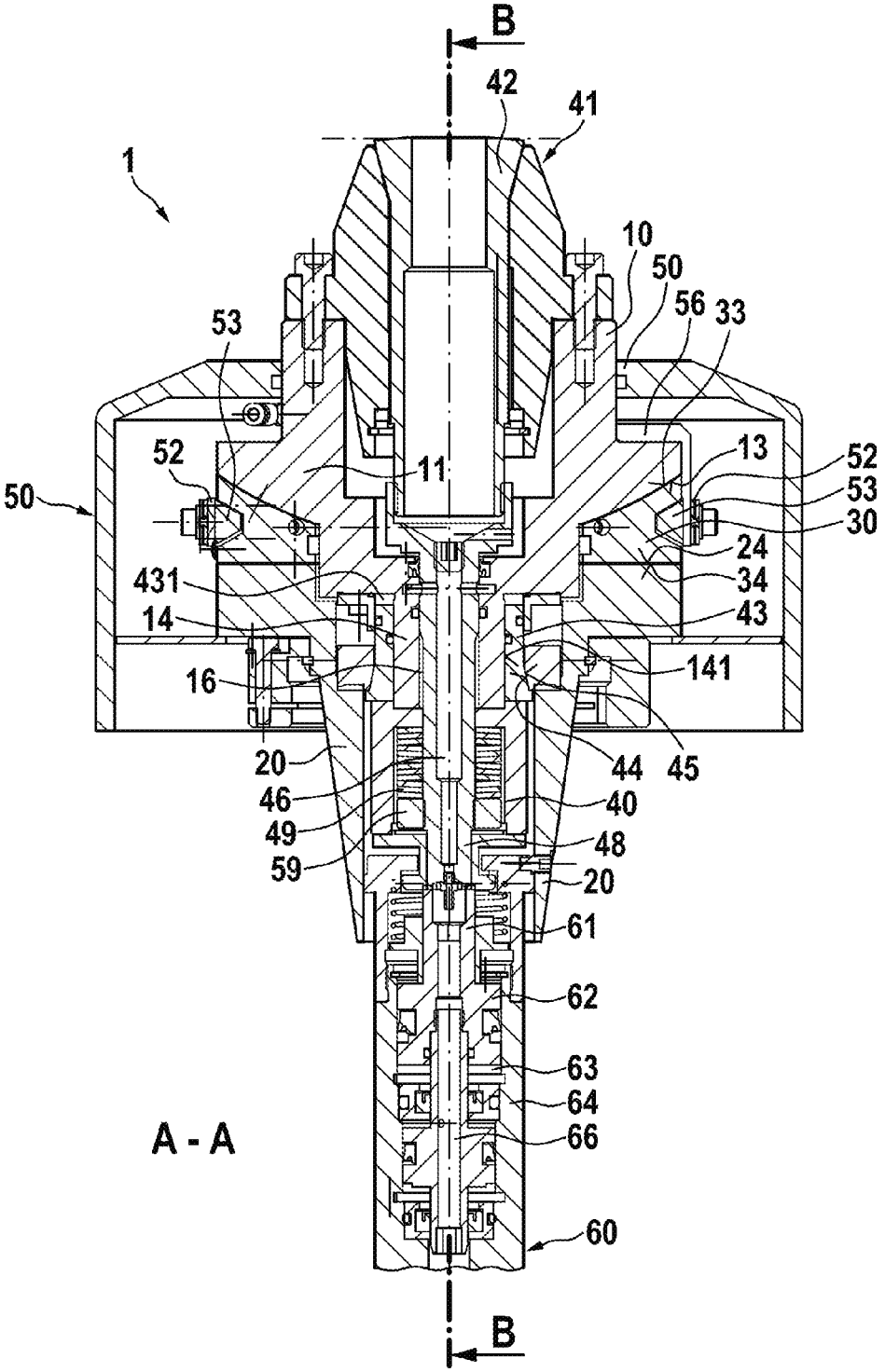
FIG. 6 shows a longitudinal section of the spindle along the plane A-A of FIG. 5.
Figure 7:
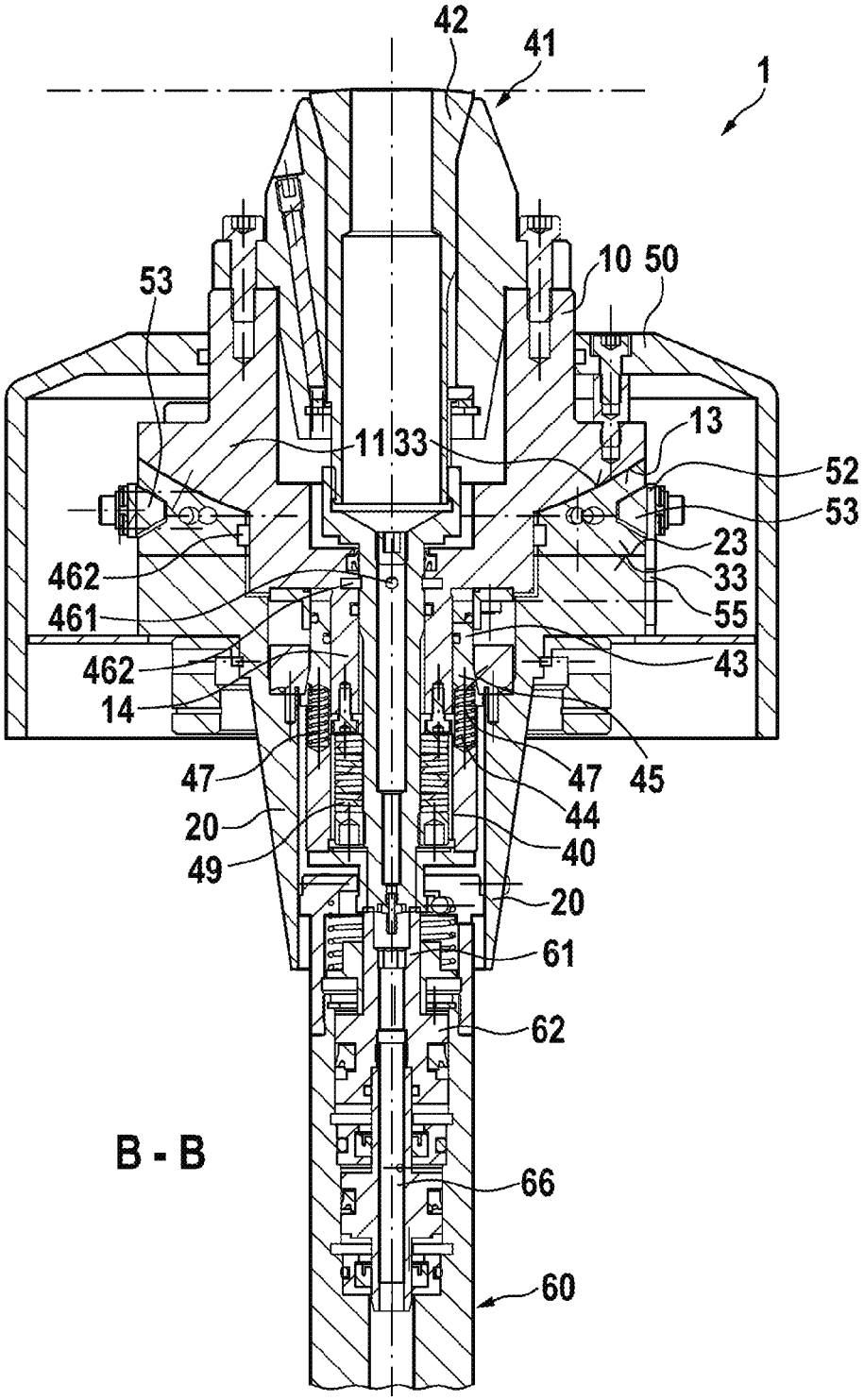
FIG. 7 shows a longitudinal section of the spindle along the plane B-B of FIG. 6.

As can be seen best in FIGS. 6 and 7, the spindle 1 has a bearing which allows a radial displacement of the drive shaft 20 and the spindle head 10, as well as a mutual tilting of the drive shaft 20 and spindle head 10. The bearing consists of two partial bearings, which form a front partial bearing and a rear partial bearing. The rear partial bearing has two opposite and mutually displaceable bearing surfaces 24, 34. For this purpose, the drive shaft 20 can have a planar annular rear bearing surface 24, which is cut preferably orthogonally by the longitudinal axis of the drive shaft 20, i.e. of the rear spindle portion 20. In this sense, the rear spindle portion 20 is or has a bearing block. Opposite to the first bearing surface 24 of the rear bearing lies a second bearing surface 34 of the intermediate block, which second bearing surface is complementary, conforming in shape to the first bearing surface. Preferably, a thin air gap is between the two bearing surfaces 24, 34, which air gap may be fed with compressed air, for example via an air duct 46. Also alternative fluids may be used as lubricants. The rear spindle portion 20 and the intermediate block 30 thus form a linear bearing with two degrees of freedom; in other words, the intermediate block is radially slideable relative to the rear spindle portion 20. The intermediate part 30 would also be rotatable against the drive shaft 20 without the coupling described further below, therefore the rear partial bearing has, strictly speaking, three degrees of freedom.

The front partial bearing is also formed by first and second bearing surfaces 33, 13, which are complementary in shape and each of which preferably has a shape conforming to a shape of a surface of a spherical segment. For this purpose, a first spherical-segment-shaped bearing surface 33 may be located on the side of the intermediate block 30 being opposite to the annular bearing surface 34. A bearing surface 13 of the spindle head 10 lies opposite to this bearing surface 33. Again, the gap between the bearing surfaces 33, 13 may be fed with compressed air or another fluid. Consequently, the front partial bearing allows tilting of the spindle head 10 relative to the rear spindle portion 20 around a center point common to these spherical-segment-shaped surfaces (2 degrees of freedom). Without the coupling described further below, the spindle head 10 would also be rotatable against the intermediate part 30; thus, also the front partial bearing has, strictly speaking, three degrees of freedom. In the illustrated example, the center point of the spherical surface segments is in the zone of the not shown workpiece. This has the advantage that a radial displacement in wobble compensation remains very small, and that the center of gravity of the spindle head lies below the rotation point in tilting; the spindle head therefore does not tip over, but is self-centering to the vertical in a spindle with an upright spindle axis.

The first partial bearing and also the second partial bearing are preloaded against each other by permanent magnets. These are, however, outside the both sectional planes being offset from one another by 90°, and are therefore not visible. The magnets are arranged annularly around the longitudinal axes of the corresponding components in recesses of the bearing blocks.

Other than illustrated, also the front partial bearing could be a linear bearing and the rear partial bearing a ball joint. For the invention, it is only important that the partial bearings together preferably allow both, tilting with two degrees of freedom as well as a radial offset (also with 2 degrees of freedom) of the longitudinal axes of the spindle head 10 and the rear spindle portion 20, and are as torsionally rigid as possible, wherefore a coupling may be provided.

To make the bearing torsionally rigid, it is bridged by a rotating coupling in the illustrated example. Their elements are best shown in FIGS. 1 to 4: The rear spindle portion 20 is connected with a coupling element 53 via two mutually parallel first struts 51 (FIG. 1 to FIG. 4 and FIG. 5 with FIG. 6). The coupling element is composed of two ring halves and surrounds the intermediate block 30 in a ring-like manner, however it does not abut to the intermediate block at least in its rest position. The coupling element is held in its position by first struts 51 and second struts 52.

For fastening the first struts 51, the rear spindle portion 20 has fastening elements 55 on two sides lying mutually diametrically opposite with respect to the longitudinal axis of the drive shaft, e.g. the illustrated elbows 55, to which one respective end of a first strut 51 is fastened. The other end of the first strut 52 is force-fittingly connected to the coupling element 53. As illustrated, the longitudinal axes of the first struts 51 run preferably at least approximately parallel (±15°, particularly preferred ±5°, even more preferred ±1°) to each other, in a plane orthogonally intersecting the longitudinal axis of the intermediate plane. Further two (second) struts 52 may be arranged in the same plane. The further struts 52 are connected to the coupling element 53 at two diametrally opposing sides in the same manner, but offset by 90° with respect to the first struts 51. The other end of the second struts 52 is force-fittingly connected to the spindle head 10 via second fastening elements 56 (e.g. elbows 56). Thus, the struts 51, 52 form a rotating coupling together with the coupling element 53 (see FIG. 5). A radial displacement of the spindle head 10 to the rear spindle portion 20 is only affected by low restoring forces of the struts 51, 52. The same holds true for the wobble movement of the spindle head 10 to the rear spindle portion 20.

As can be clearly seen in FIG. 6 and FIG. 7, the spindle has a centering device with which the spindle head 10 can be centered with the rear spindle portion 20 e.g. when inserting and/or removing a workpiece into and/or out of the collet 42, i.e. the bearing is locked. For this purpose, the rear spindle portion 20 has at least one first ring-shaped or ring-segment-shaped centering surface 44 which, in the example shown, tapers conically toward the spindle head 10. A ring-shaped or alternatively ring-segment-shaped piston with a shell surface section 45 tapering toward the spindle head 10 lies at the first centering surface 44 as a centering slide 43. The centering slide 43 is axially displaceable on a preferably cylindrical contact surface 141 of an axial pin 14 of the spindle head 10, which forms the second centering surface. The centering slide 43 is preloaded toward the spindle head 10 by means of elastic elements 47 (can only be seen in FIG. 7), such that the centering slide 43 is clamped with its shell surface section 45 against the first centering surface, whereby the spindle head 10 is centered relative to the rear spindle portion. To unlock the centering and thereby release the bearing, the piston may be charged with a fluid, e.g. compressed air, on the spindle head side, in order to displace it against the elastic elements, such that the shell surface section does no more contact at the first centering surface.

At its rear end, the collet is connected to a pulling member 48, herein a rod (cf. FIG. 6 and FIG. 7). The rod 48 is located in a continuous recess 16 of the spindle head 10 and is tensionally preloaded by a clamping element 49 supported by the spindle head 10 (a plate spring package is illustrated) toward the rear spindle portion 10. For this purpose, a clamping ring 59 is located on the rod, to which clamping ring a clamping element 49 engages. The clamping element is in a chamber 40 of the spindle head 10. To open the collet 42, the rod 48 is moved axially toward the collet.

The rod 48 has an axial recess 46, which serves as an air duct 46 for supplying compressed air (or other fluid) for the bearing and at the same time for opening the centering device. For this purpose the air duct 46 is connected via holes 461, or punctures 462 with the gaps between the bearing surfaces 13, 33 and 24, 34 as well as with the sealed annular gap 431 in which the centering slide is located. If the air duct 46 is charged with compressed air, the centering device is first displaced and the bearing is released. Once the pressure is large enough, such that the magnetic preload is compensated, the bearing is freely moveable.

To open the collet 42, a piston rod 61 of the air duct and actuating unit 60 is located in the axial extension of the rear spindle portion 20, which piston rod is connected to (at least one) piston 62. The piston 62 is located in a recess 63 of the housing 64 of the air duct and actuating unit 60, which recess 63 serves as a cylinder for the piston 62, and the piston 62 is pressure-chargeable against the restoring force of a restoring element 65, whereby the piston 62 and thus also the piston rod 61 are displaced toward the collet, and thus the tension element, i.e. the rod 48 is relieved. Also the piston rod 61 and the piston 62 have an axial channel 66, which is connected in communication with the air duct 46. To connect the axial channel 66 and the air duct 46, the rod 48 has a radial protrusion at its distal end, which can be inserted into a complementary recess of the piston rod and then be locked in the recess by a rotation of 90°.

Figure 8:
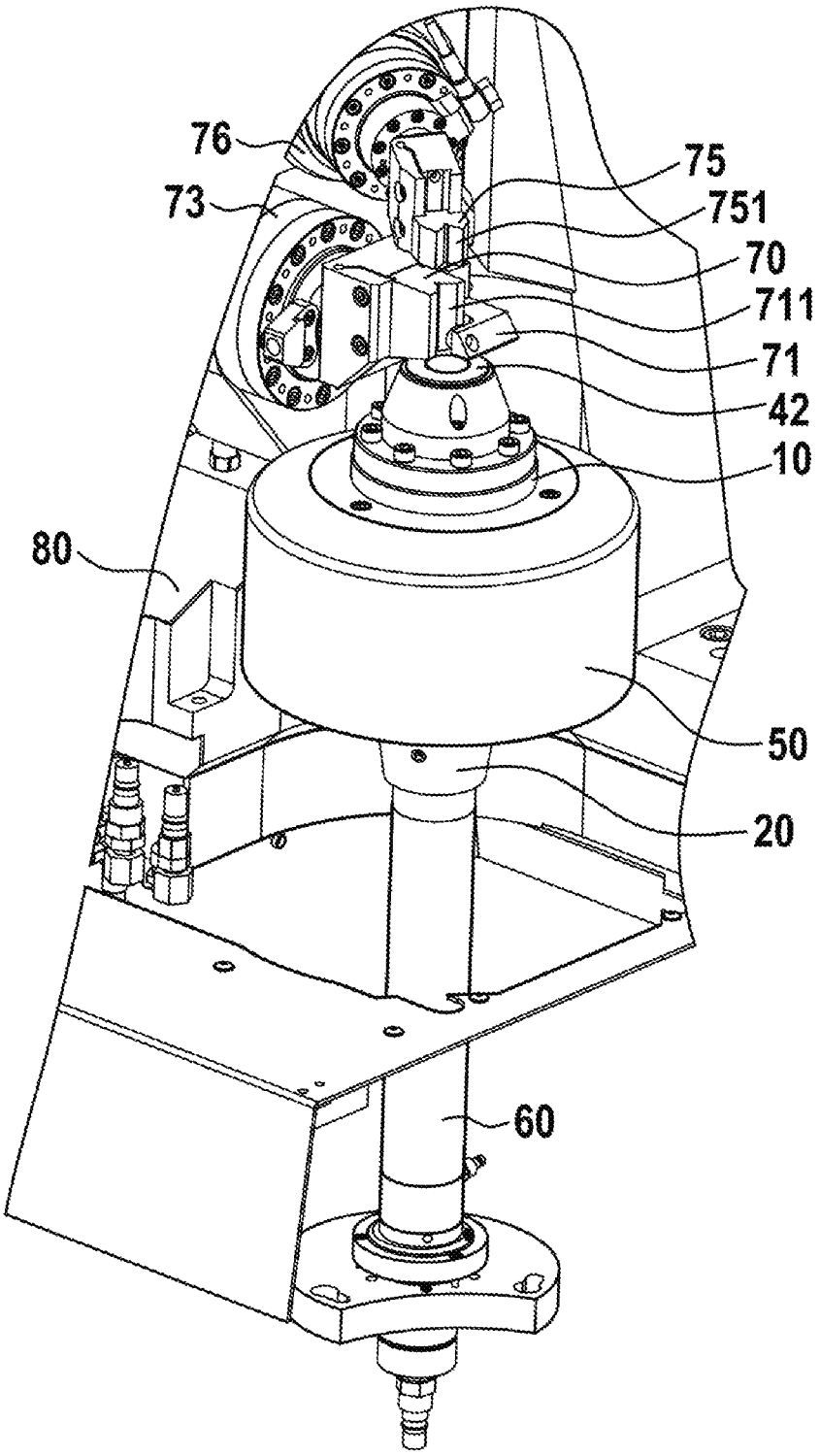
FIG. 8 shows a spindle in a partially assembled tool grinder machine.

In FIG. 8, the spindle is illustrated together with some elements of a machine tool grinder. The spindle head, the optional cabin, the grinding head along with drive and slide unit are not shown for the sake of clarity. Preferably, the spindle is arranged standing, as shown, i.e. its longitudinal axis corresponds at least approximately (±15°) to the vertical. At a support unit 80, which is force-fittingly connected to the machine frame only partially shown, a prism 70 with a clamping finger 71 and a steady rest 75 are arranged. The guiding prism 70 has a groove 711 in which a workpiece can be fixed with the clamping finger. The position and orientation of the guiding prism 70 relative to the support unit 80 and thus to the spindle can be varied by means of a setting unit 73, until a desired position is reached. In the desired position, the same of the guiding prism 70 as well as of the clamping finger 71 can be set. In the same way, the steady rest 75 is adjustable in a desired position and orientation by means of a further adjustment unit 76, and can be fixed there.

For grinding a workpiece, a workpiece or preferably a calibration mandrel is first inserted into the collet, while the bearing between the spindle head 10 and the rear spindle portion is preferably locked by means of the centering device. Now, the guiding prism and the steady rest can be attached to the calibrating mandrel or the workpiece, respectively, and can be fixed in the corresponding position. Before fixing the position and orientation of the guiding prism 70, the clamping finger 71 is preferably charged towards the guiding prism 70, whereby the latter is properly attached to the workpiece. In other words, the workpiece now lies in the corresponding grooves 711, 751 of the guide prism or the steady rest, respectively. Now, the calibration mandrel can be replaced by a workpiece, if necessary. Subsequently, the centering device is opened, i.e. the bearing is released, and the machining of the workpiece can start. The machining forces, as far as they act in the workpiece in radial direction, are exclusively absorbed by the guide prism 70 and the steady rest 75, respectively. Even when rotating the workpiece in the V-grooves 711, 751, the position of the workpiece is determined only (at least in radial direction) by the guide prism 70 and the steady rest 75. Even when rotating the workpiece, no radial forces are transmitted from the rear portion 20 to the workpiece due to the bearing between the spindle head 10 and the rear spindle portion 20, wherein the precision in positioning the work-piece in machining is improved.

It will be appreciated to those skilled in the art having the benefit of this disclosure that this invention is believed to provide a spindle for a machine tool. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 spindle head (briefly: "head")
11 bearing block of the spindle head (briefly: "head block")
13 bearing surface
14 axial pin
141 contact surface for centering ring/centering surface
16 continuous recess
20 rear spindle portion/drive shaft
24 bearing surface
30 intermediate portion/intermediate block
33 bearing surface
34 bearing surface
40 chamber for clamping element
41 collet receptacle, more general: clamping element receptacle
42 collet, more general: clamping means
43 centering slide/tapering slide
431 ring gap
44 conical shell surface section
45 conical contact surface for centering slide
46 air duct
461 hole
462 puncture
47 elastic elements
48 tension element, here rod
49 clamping element, e.g. plate spring
50 cover
51 first struts (from drive shaft 20 to intermediate block 30)
52 second struts (from intermediate block 30 to spindle head 10)
53 coupling element
55 first fastening elements for struts 51 (e.g. elbows)
56 second fastening elements for struts 52 (e.g. elbows)
60 air duct und actuating unit
61 piston rod
62 piston
63 recess/cylinder
64 housing
66 channel
70 prism/guiding prism/support prism
71 clamping finger
75 steady rest
73 adjustment unit for support prism
76 adjustment unit for steady rest
80 support unit

The invention claimed is:

1. A spindle for a machine tool comprising at least:
a spindle head, having a first longitudinal axis and being configured to receive a clamping means, and
a rear spindle portion, having a second longitudinal axis and configured to be received in a bearing block and as a drive shaft for the spindle head,
at least one bearing arranged between the spindle head and the rear spindle portion and connecting them, wherein the at least one bearing:
is sized to allow, in operation of the spindle, a wobbling movement between the spindle head and the rear spindle portion, and
is configured to transmit at least one of compression and tensile forces in a longitudinal direction from the spindle head to the drive shaft, and
is bridged by at least one coupling configured to transmit torques between the rear spindle portion and the spindle head.

2. The spindle according to claim 1, wherein
the spindle head and the rear spindle portion have respective centering surfaces that are opposite to one another, between which a tapered centering slider is slideably movable between at least a first position and a second position, wherein in the first position the at least one bearing is bridged in a locking manner, whereby the spindle head and the rear spindle portion are mutually centered.

3. The spindle according to claim 1, wherein
the at least one bearing has at least one of first and second partial bearings,
wherein the first partial bearing has two complementary first bearing blocks with spherical-segment-shaped bearing surfaces and
wherein the second partial bearing has two complementary bearing blocks with planar bearing surfaces, said planar bearing surfaces having respectively-corresponding surface normals, said surface normals being parallel to either the first longitudinal axis or the second longitudinal axis.

4. The spindle according to claim 3, wherein
the at least one bearing has an intermediate portion formed as a ring or a ring segment,
the at least one bearing having a first bearing surface that is either a spherical-segment-shaped surface or a cylinder-segment-shaped surface,
the at least one bearing having a second bearing surface that is either a planar surface or a cylinder-segment-shaped surface, the second bearing surface located on a side of the at least one bearing that is facing away from the first bearing surface.

5. The spindle according to claim 3, wherein
at least one of the first and second partial bearings is a hydrostatic bearing with a fluid gap between at least two of bearing surfaces.

6. The spindle according to claim 5, wherein
bearing blocks of at least one of the first and second partial bearings are preloaded against each other by a magnetic force.

7. The spindle according to claim 6, wherein
at least one permanent magnet is arranged in at least a first of two complementary bearing blocks, wherein magnetic flux of the at least one permanent magnet is guided from a magnetic north pole thereof to a magnetic south pole thereof such as to bridge at least once an air gap between the bearing surfaces, to thereby pre-load the bearing blocks by a magnetic force.

8. The spindle according to claim 1, wherein
the at least one bearing has at least one of first and second partial bearings, wherein the first partial bearing has two mutually complementary first bearing blocks with first cylinder-segment-shaped bearing surfaces, and the second partial bearing has two mutually complementary second bearing blocks with second cylinder-segment-shaped bearing surfaces.

9. The spindle according to claim 8, wherein
the at least one bearing has a ring-shaped or ring-segment-shaped intermediate portion
having at least one first bearing surface that is a spherical-segment-shaped surface or a cylinder-segment-shaped surface and
having, on a side of said intermediate portion that faces facing away from the at least one first bearing surface, at least one second bearing surface that is either a planar surface or a cylinder-segment-shaped surface.

10. The spindle according to claim 8, wherein at least one of the first and second partial bearings is a hydrostatic bearing with a fluid gap between at least two of bearing surfaces.

11. The spindle according to claim 10, wherein bearing blocks of at least one of the first and second partial bearings are preloaded against each other by a magnetic force.

12. The spindle according to claim 11, wherein at least one permanent magnet is arranged in at least a first of two complementary bearing blocks, wherein the magnetic flux of the at least one permanent magnet is guided from a magnetic north pole thereof to a magnetic south pole thereof such as to bridge at least once an air gap between the bearing surfaces, to thereby pre-load the bearing blocks by a magnetic force.

13. The spindle according to claim 1, wherein the spindle head has a continuous recess, in one side of which at least one clamping means is located, which is connected to a tension element being arranged in the recess and being preloaded against the spindle head.

14. The spindle according to claim 1, wherein the at least one coupling has elastically deformable struts including an elastically deformable strut on each of two sides of at least one of the first and second longitudinal axes, which elastically deformable struts connect the spindle head and the spindle portion at least indirectly torsion-proof to each other.

15. The spindle according to claim 1, wherein the at least one bearing is configured to effectuate a radial displacement of the spindle head and the first longitudinal axis relative to the rear spindle portion and relative to the second longitudinal axis.

16. The spindle according to claim 1, wherein the at least one bearing is sized to compensate, as a result of said wobbling movement, for errors in alignment of a workpiece, which is clamped in said machine tool during the operation, with respect to the second longitudinal axis.

17. A spindle for a machine tool comprising at least:

a spindle head, having a first longitudinal axis and configured to receive a clamping means, and a rear spindle portion, having a second longitudinal axis and configured to be received in a bearing block and as a drive shaft for the spindle head, at least one bearing arranged between the spindle head and the rear spindle portion and connecting them, wherein the at least one bearing:

is configured to allow at least one of tilting and pivoting of the spindle head and the of first longitudinal axis relative to the rear spindle portion and relative to the second longitudinal axis, and Is configured to transmit at least one of compression and tensile forces in a longitudinal direction from the spindle head to the drive shaft, and is bridged by at least one coupling configured to transmit torques between the rear spindle portion and the spindle head;

wherein the spindle head and the rear spindle portion have respective centering surfaces that are opposite to one another, between which a tapered centering slider is slideably movable between at least a first position and a second position, wherein in the first position the at least one bearing is bridged in a locking manner, whereby the spindle head and the rear spindle portion are mutually centered.

18. The spindle according to claim 17, wherein the at least one bearing has at least one of first and second partial bearings, wherein the first partial bearing has two mutually complementary first bearing blocks with first cylinder-segment-shaped bearing surfaces, and the second partial bearing has two mutually complementary second bearing blocks with second cylinder-segment-shaped bearing surfaces.

19. The spindle according to claim 17, wherein the spindle head has a continuous recess, in one side of which at least one clamping means is located, which is connected to a tension element being arranged in the recess and being preloaded against the spindle head.

20. The spindle according to claim 17, wherein the at least one coupling has elastically deformable struts including an elastically deformable strut on each of two sides of at least one of the first and second longitudinal axes, which elastically deformable struts connect the spindle head and the spindle portion at least indirectly torsion-proof to each other.

21. The spindle according to claim 17, wherein the at least one bearing is configured to effectuate a radial displacement of the spindle head and the first longitudinal axis relative to the rear spindle portion and relative to the second longitudinal axis.

22. A spindle for a machine tool comprising at least:

a spindle head, having a first longitudinal axis and being configured to receive a clamping means, and a rear spindle portion, having a second longitudinal axis and configured to be received in a bearing block and as a drive shaft for the spindle head, at least one bearing arranged between the spindle head and the rear spindle portion and connecting them, wherein the at least one bearing:

is configured to allow at least one of tilting and pivoting of the spindle head and of the first longitudinal axis relative to the rear spindle portion and relative to the second longitudinal axis, and is configured to transmit at least one of compression and tensile forces in a longitudinal direction from the spindle head to the drive shaft, and is bridged by at least one coupling configured to transmit torques between the rear spindle portion and the spindle head;

wherein the at least one bearing has at least one of first and second partial bearings, and the first partial bearing has two complementary first bearing blocks with spherical-segment-shaped bearing surfaces and the second partial bearing has two complementary bearing blocks with planar bearing surfaces, said planar bearing surfaces having respectively-corresponding surface normals, said surface normals being parallel to either the first longitudinal axis or the second longitudinal axis.

23. The spindle according to claim 22, wherein the at least one bearing has at least one of first and second partial bearings, wherein the first partial bearing has two mutually complementary first bearing blocks with first cylinder-segment-shaped bearing surfaces, and the second partial bearing has two mutually complementary second bearing blocks with second cylinder-segment-shaped bearing surfaces.

24. The spindle according to claim 23, wherein at least one of the first and second partial bearings is a hydrostatic bearing with a fluid gap between at least two of bearing surfaces.

25. The spindle according to claim 24, wherein bearing blocks of at least one of the first and second partial bearings are preloaded against each other by a magnetic force.

26. The spindle according to claim 25, wherein at least one permanent magnet is arranged in at least a first of two complementary bearing blocks, wherein the magnetic flux of the at least one permanent magnet is guided from a magnetic north pole thereof to a magnetic south pole thereof such as to bridge at least once an air gap between the bearing surfaces, to thereby pre-load the bearing blocks by a magnetic force.

27. The spindle according to claim 22, wherein the at least one bearing has a ring-shaped or ring-segment-shaped intermediate portion having at least one first bearing surface that is a spherical-segment-shaped surface or a cylinder-segment-shaped surface and having, on a side of said intermediate portion that faces facing away from the at least one first bearing surface, at least one second bearing surface that is either a planar surface or a cylinder-segment-shaped surface.

28. The spindle according to claim 22, wherein at least one of the first and second partial bearings is a hydrostatic bearing with a fluid gap between at least two of bearing surfaces.

29. The spindle according to claim 28, wherein bearing blocks of at least one of the first and second partial bearings are preloaded against each other by a magnetic force.

30. The spindle according to claim 29, wherein at least one permanent magnet is arranged in at least a first one of two complementary bearing blocks, wherein magnetic flux of the at least one permanent magnet is guided from a magnetic north pole thereof to a magnetic south pole thereof such as to bridge at least once an air gap between the bearing surfaces, to thereby pre-load the bearing blocks by a magnetic force.

* * * * *